US005780970A

United States Patent [19]

Singh et al.

[11] Patent Number: 5,780,970

[45] Date of Patent: Jul. 14, 1998

[54] MULTI-STAGE DEPRESSED COLLECTOR FOR SMALL ORBIT GYROTRONS

[75] Inventors: Amarjit Singh, Greenbelt, Md.; R. Lawrence Ives, Saratoga, Calif.; Richard V. Schumacher, Campbell, Calif.; Yosuke M. Mizuhara, Palo Alto, Calif.

[73] Assignees: University of Maryland, College Park, Md.; Calabazas Creek Research Center, Inc., Saratoga, Calif.

[21] Appl. No.: 740,108

[22] Filed: Oct. 28, 1996

[51] Int. Cl.[6] ..... H01J 23/027

[52] U.S. Cl. ..... 315/5.38

[58] Field of Search ..... 315/5.38

[56] References Cited

U.S. PATENT DOCUMENTS

| | | | |
|---|---|---|---|
| 3,153,743 | 10/1964 | Meyerer | 315/5.38 |
| 3,368,102 | 2/1968 | Saharian | 315/3 |
| 3,368,104 | 2/1968 | McCullough | 315/5.38 |
| 3,394,282 | 7/1968 | Schmidt | 315/5.38 |
| 3,450,930 | 6/1969 | Lien | 315/3.5 |
| 3,644,778 | 2/1972 | Mihran et al. | 315/5.38 |
| 3,702,951 | 11/1972 | Kosmahl | 315/5.38 |
| 3,764,850 | 10/1973 | Kosmahl | 315/5.38 |
| 3,824,425 | 7/1974 | Rawls, Jr. | 315/5.38 |
| 3,993,925 | 11/1976 | Achter et al. | 315/5.38 |
| 4,096,409 | 6/1978 | Hechtel | 315/5.38 |
| 4,189,660 | 2/1980 | Dandl | 315/5.38 |
| 4,250,430 | 2/1981 | Heynisch | 315/5.38 |
| 4,277,721 | 7/1981 | Kosmahl | 315/5.38 |
| 4,395,656 | 7/1983 | Kosmahl | 315/4 |
| 4,398,122 | 8/1983 | Gosset | 315/5.38 |
| 4,621,219 | 11/1986 | Fox et al. | 315/5 |
| 4,794,303 | 12/1988 | Hechtel et al. | 315/5.38 |
| 4,933,594 | 6/1990 | Faillon et al. | 315/5 X |
| 5,283,534 | 2/1994 | Bohlen et al. | 315/5.38 |
| 5,389,854 | 2/1995 | True | 315/5.38 |
| 5,420,478 | 5/1995 | Scheitrum | 315/5.38 |
| 5,440,202 | 8/1995 | Mathews et al. | 315/3 |

FOREIGN PATENT DOCUMENTS

| | | |
|---|---|---|
| 53-124057 | 10/1978 | Japan . |
| 55-139740 | 10/1980 | Japan . |
| 57-69646 | 4/1982 | Japan . |
| 58-34544 | 3/1983 | Japan . |
| 59-198636 | 11/1984 | Japan . |
| 63-213242 | 9/1988 | Japan . |
| 541169 | 2/1993 | Japan . |
| 6150837 | 5/1994 | Japan . |

OTHER PUBLICATIONS

Gross et al., "Method of Controlling Secondary Electrons For Minimization of Intermodulation in a TWT", Western Electric Technical Digest, No. 45, pp. 17–18, Jan. 1977.

*Primary Examiner*—Robert J. Pascal
*Assistant Examiner*—Justin P. Bettendorf
*Attorney, Agent, or Firm*—Watson Cole Grindle Watson, P.L.L.C.

[57] ABSTRACT

A multi-stage depressed collector for receiving energy from a small orbit gyrating electron beam employs a plurality of electrodes at different potentials for sorting the individual electrons on the basis of their total energy level. Magnetic field generating coils, for producing magnetic fields and magnetic iron for magnetic field shaping produce adiabatic and controlled non-adiabatic transitions of the incident electron beam to further facilitate the sorting.

21 Claims, 8 Drawing Sheets

MAGNETIC FLUX LINES IN 2 STAGE DEPRESSED COLLECTOR

Psi CONTOURS AND TRAJECTORIES FOR DEPRESSED COLLECTORS

MULTI-STAGE DEPRESSED COLLECTOR FOR SMALL ORBIT GYROTRONS

GOVERNMENT RIGHTS

This invention was made with government support under Grant DE-FG03-95ER81937 awarded by the Department of Energy. The government has certain rights in this invention.

BACKGROUND OF THE INVENTION

1.1 Field of the Invention

The invention relates to an electron beam collector capable of recovering electron energy in a microwave device using a small orbit, gyrating electron beam. In particular, the invention employs a high efficiency multiple stage collector in combination with a magnetic circuit resulting in energy sorting of beamlets and their collection at appropriate potentials with minimal reflection.

1.2 Description of Prior Art

Collector depression has been utilized in linear beam devices for many years. Linear beam devices include helix and coupled cavity traveling wave tubes (TWTs) and klystrons. These devices utilize an electron beam to produce rf power by modulating the electron beam and extracting some fraction of the energy in an interaction region or circuit. The remaining energy in the beam is dissipated in the collector region as thermal energy. By applying negative voltages to the collector surfaces with respect to the interaction region, some portion of the energy in the spent beam can be recovered. Thus, the amount of electrical power required to drive the device may be reduced, and the thermal energy deposited in the collector minimized. This increases the overall efficiency of the device.

In known linear beam devices, a magnetic field is typically used to focus the electron beam and conduct it through the interaction or circuit region and into the collector. In most cases, an iron pole piece is used to terminate the magnetic field at the entrance to the collector. The space charge force in the beam causes the electron beam to expand radially. Electrons with less axial energy expand most rapidly, causing a natural sorting of the electrons. This sorting is augmented by the electrostatic field created by the collector electrodes. Electrodes are located to collect the electrons, lower potential electrodes positioned to intercept slower electrons and higher (more negative) potential electrodes located further from the electron gun to collect higher energy electrons.

A typical example of a known linear beam device 10 is shown in FIG. 1. An electron beam 12 is generated by an electron gun 14 having a cathode 16. The beam 12 enters the interaction region 17 where it is shaped by a magnetic field and wherein a fraction of the beam energy is converted to microwave power and extracted through a waveguide 18. The electron beam 12 continues into the collector region 20 where the magnetic field is terminated by the iron pole piece 22, and space charge forces cause the electron beam 12 to diverge radially into beamlets 12-1 . . . 12-n, as shown. The collector electrode including charged surfaces 24–27 are energized at voltages between ground and the cathode voltage, with the voltage on electrode 24 being closest to ground and that on electrode 27 being closest to that of the cathode. This reduces the electrical power needed to generate the electron beam and also reduces the thermal power deposited in the collector. Note also that electrical isolation between collector stages is obtained using ceramic cylinders 28 located radially outward from the electron beam.

Depressed collectors of this type are discussed in U.S. Pat. No. 4,398,122 by Philippe Gosset, U.S. Pat. No. 4,794,303 by Hechtel et al., U.S. Pat. Nos. 3,764,850 and 4,277,721 by Kosmahl, and U.S. Pat. No. 3,824,425 by John Rawls.

In known linear beam devices, sorting of the beam 12 into beamlets 12-1 . . . 12-n according to energy depends on the forces exerted by the space charge and the electrostatic field, without the complication of a magnetic field, as the latter is reduced to a negligible value in the collector region 20. As discussed below, the gyrotron family of devices has a much higher value of the magnetic field in the interaction region 16. There are practical as well as theoretical problems associated with making the field to go to a negligible value in the collector region 20.

Gyrotron type devices typically employ a hollow electron beam where the microwave power is extracted from the transverse energy in the electron beam. The hollow beam can be characterized as either a large orbit beam 30 (FIG. 2A) in which the electrons 32 spiral about a guiding center 34 near the beam axis, or a small orbit beam 36 (FIG. 2B) in which the electrons 32 orbit around individual flux lines 38 of the magnetic field centered on the guiding center 34. In the case of gyrotrons, the magnetic field plays a direct role in the basic process of transfer to energy from the beam to the electromagnetic field. The electron beam is made to gyrate in the interaction region. While the energy in transverse motion is converted in part into the energy of the desired electromagnetic wave, the spent electron beam still has a significant proportion of its residual energy in transverse motion. As a result, the beam is likely to turn back before being collected at a depressed potential at the stage where the forward energy alone has been delivered to the retarding electrostatic field.

In a large orbit gyrotron, of the type shown in Scheitrum, U.S. Pat. No. 5,420,478, a plurality of conical, annular collector electrodes are employed with the first of the electrode stages having the greatest negative potential with respect to the microwave device, and subsequent stages having decreasing relative potential. The collector sorts the electrons according to their radial energy with electrons having the highest radial energy collected on the first electrode and electrons having lesser amounts of radial energy being collected on the subsequent electrodes. The patent is relevant to Large Orbit Gyrotrons, in which the electron beam is an axis-encircling beam. The dynamics of the spent beam is different from the case of small orbit gyrotron, in which the electrons gyrate in tightly wound spirals within a fraction of the thickness of the beam. The theory postulated for conversion of energy to radial energy and its subsequent sorting is not applicable.

Gyrotrons typically operate in the frequency range of tens or even hundreds of gigahertz. The magnetic field is proportional to the cyclotron frequency, which is in the vicinity of the operating frequency. This implies that the magnetic field is in the range of many tens of kilogauss which is thus much larger than the magnetic field used for focusing the beam in linear beam tubes. Thus, if in the collector region the magnetic field has to be reduced to extremely low values, then the ratio in which the magnetic field is reduced, as between the interaction region and the collector region, becomes very large.

A gradual reduction of magnetic field results in an expansion of the beam in a ratio that is the square root of the ratio in which the magnetic field is diminished. In millimeter wave gyrotrons this would lead to collector diameters and insulator sizes that would be excessively large.

In U.S. Pat. No. 3,764,850, an abrupt transition to a low magnetic field at the entrance to the collector region is postulated. When the percentage change in the magnetic field accompanying progression through one period of gyration is large or abrupt, the transition is termed non-adiabatic. In such a case, the electrons cross lines of magnetic flux resulting in transfer of energy from forward motion to transverse motion. This can cause the electrons to return towards the interaction region before being collected. A large and rapid change of the kind just mentioned is thus undesirable in the environment of the gyrotron family of tubes.

On the other hand, in an adiabatic transition resulting from a slowly varying magnetic field, the beamlets of different energies all tend to follow the magnetic flux lines. This provides no separation of energies. The electron beam thus falls on a relatively restricted area of the collector with a correspondingly high heat dissipation density.

In the depressed collector configuration discussed by M. E. Read, W. Lawson, A. J. Dudas and A. Singh, 1990, the expansion of the beam due to adiabatic decompression, the effect on collector size, and feasibility of non-adiabatic field generation are considered. A design is presented for a three-stage collector for a gyrotron operating at 10 GHz. At this frequency, the magnetic field in the interaction region is relatively low compared to that needed for gyrotrons which operate typically at a frequency several times higher. As the cyclotron wavelength is longer at these field strengths, a non-adiabatic kicker coil for generating a sharply peaked magnetic field for pushing outward going electrons back toward the axis is not feasible for gyrotrons operating at these higher frequencies.

In a multiple depressed collector configuration discussed by A. Singh, G. Hazel, V. L. Granatstein and G. Saraph, 1992, a small orbit gyrotron is considered. However, there the magnetic field profiles have been restricted to smoothly varying ones generated by polynomials mathematically. Because of this limitation, the maximum collector efficiency which could be achieved for the case of four depressed potentials is about 70%. No physically realizable configuration has been presented for obtaining the magnetic field configuration.

FIG. 3 shows a known depressed collector for a small orbit gyrotron 40. A hollow electron beam 42 of gyrating electrons is generated by the cathode 43 of a magnetron injection gun 44 and enters the beam tunnel 45. The beam 42 propagates into the circuit 46 where rf power is extracted from the transverse energy of the electrons and removed from the device through rf window 47. The beam 42 continues into the collector region 48 where it impinges on the walls 49 of the collector 48. In a typical embodiment, the beam tunnel section 45 and circuit section 46 are maintained at ground potential and the electron gun 44 is maintained at some negative potential by the cathode power supply 52. Anode 51 is supplied by power supply 50, and the collector 48 is depressed to some negative potential between that of the cathode 43 and ground by power supply 53. Thus, the spent electron beam impinging on the collector walls 49 is collected at a reduced potential from ground resulting in an improvement in electrical efficiency. Electrical isolation between sections is provided by ceramic insulators 54A–54C.

Known small orbit gyrotrons, with propagation of electrons along the magnetic flux lines, provide insufficient separation between electrons of differing energies for collection on multiple stages. Consequently, depressed collectors for small orbit gyrotrons using known techniques consist of a single electrode for energy recovery. This significantly reduces the amount of energy that can be recovered from the beam. A device of this type is described by A. Kusagain et al. in a paper presented at the 1994 International Electron Devices Meeting entitled, "Development of a High Power and Long Pulse Gyrotron With Collector Potential Depression".

The spent electron beam has a range of energies in its beamlets, which may typically extend over a ratio of 1:5. In a single stage depressed collector, as the depressed potential is increased, the beamlets having the lowest energy begin to turn back before being collected. As this limits the extent of depression, only a fraction of the energy of the higher energy beamlets may be recovered. By contrast, a larger portion of the energy is recovered in multi-stage depressed collectors where higher energy beamlets are sorted and collected at higher depressed potentials.

Thus, there is a need for a multi-stage depressed collector for small orbit gyrotrons capable of effectively sorting the electrons according to energy and directing them to the most appropriate depressed electrode for maximizing the energy recovery. In particular, there is a need for innovation in the control of electron trajectories in the collector region.

SUMMARY OF THE INVENTION

The invention is based upon the discovery of a multi-stage depressed collector for connection to a microwave device generating a small orbit gyrating electron beam of individual electrons having varying levels of total energy gyrating in small orbits with respect to the total beam radius and traversing into the collector where energy is recovered from the electron beam. The collector employs means for sorting the individual electrons on the basis of their total energy level including a plurality of collector stages employing electrodes operating at different voltage potentials for producing electric fields; magnetic field generating coils for producing magnetic fields; and magnetic iron or pole pieces for magnetic field shaping. The electric and magnetic fields are configured so as to direct electrons of the highest energy to the electrode with the greatest negative potential, the electrons with the lowest energy to the electrode with the least negative potential, and electrons with intermediate energies to electrodes with intermediate voltages to thereby maximize energy recovery. The magnetic iron affects the magnetic fields so as to produce adiabatic and controlled non-adiabatic transitions of the incident electron beam to further facilitate the sorting.

DESCRIPTION OF THE INVENTION

The present invention provides a multi-stage depressed collector capable of collecting a small orbit gyrating electron beam emerging from the interaction region of microwave device, such as a gyrotron. The depressed collector sorts and collects the electrons of the spent electron beam on the basis of their relative total energy and dissipates the heat deposited by the beam.

Figure 1:
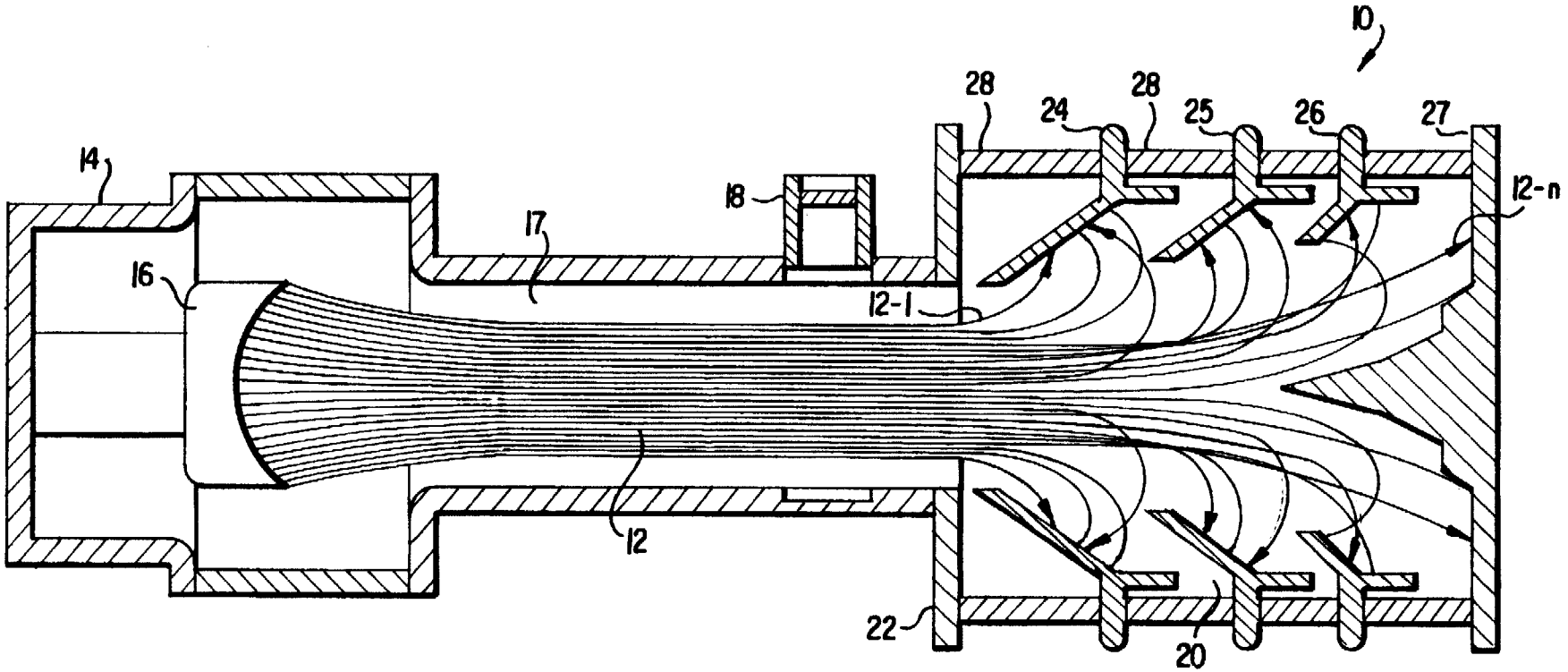
FIG. 1 (PRIOR ART)
FIG. 1 is a diagrammatic side view of a known depressed collector for non-gyrating electron beams.
Figure 2A:
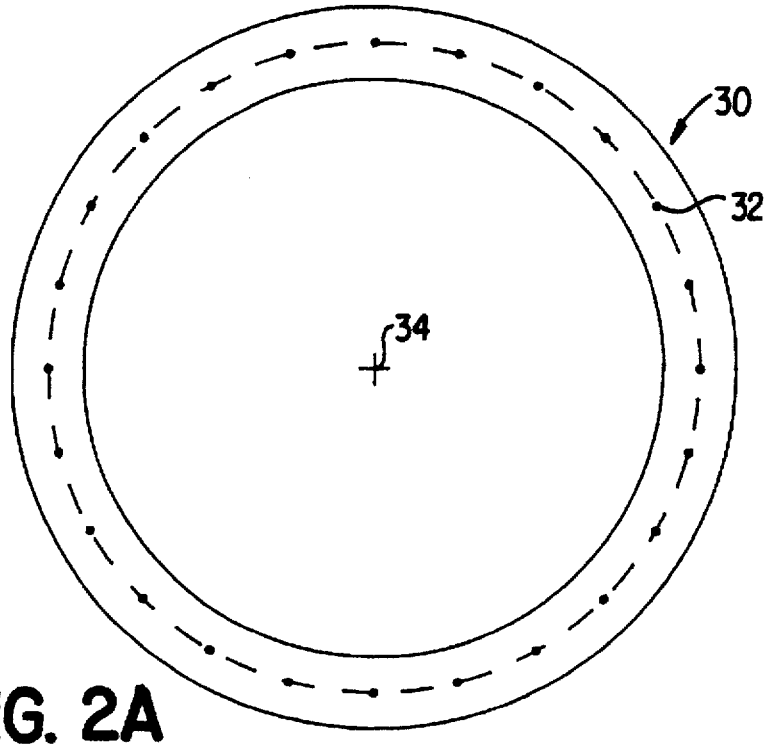
FIGS. 2A and 2B are respective sectional views of a large orbit gyrating electron beam and a small orbit gyrating electron beam.
Figure 2B:
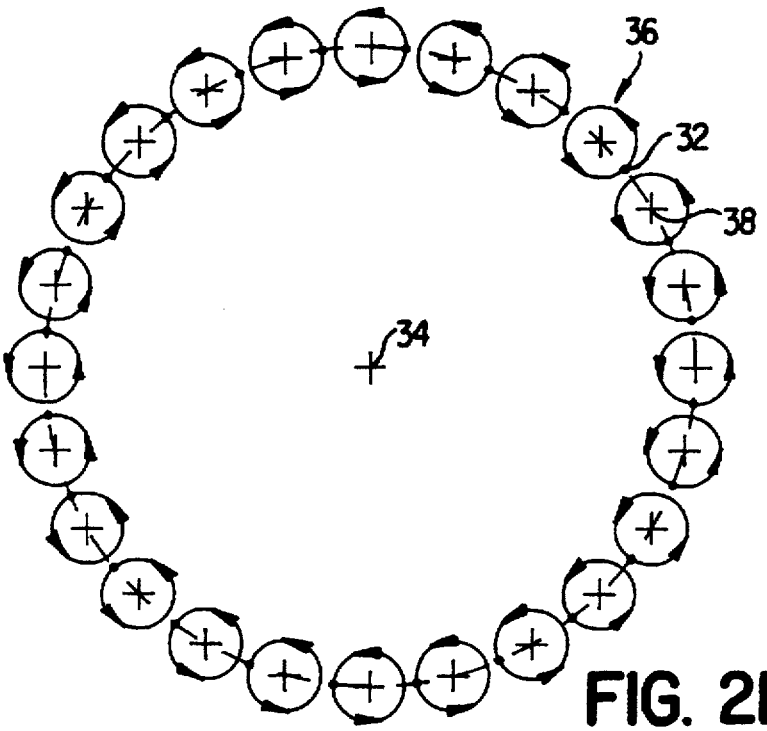
Figure 3:
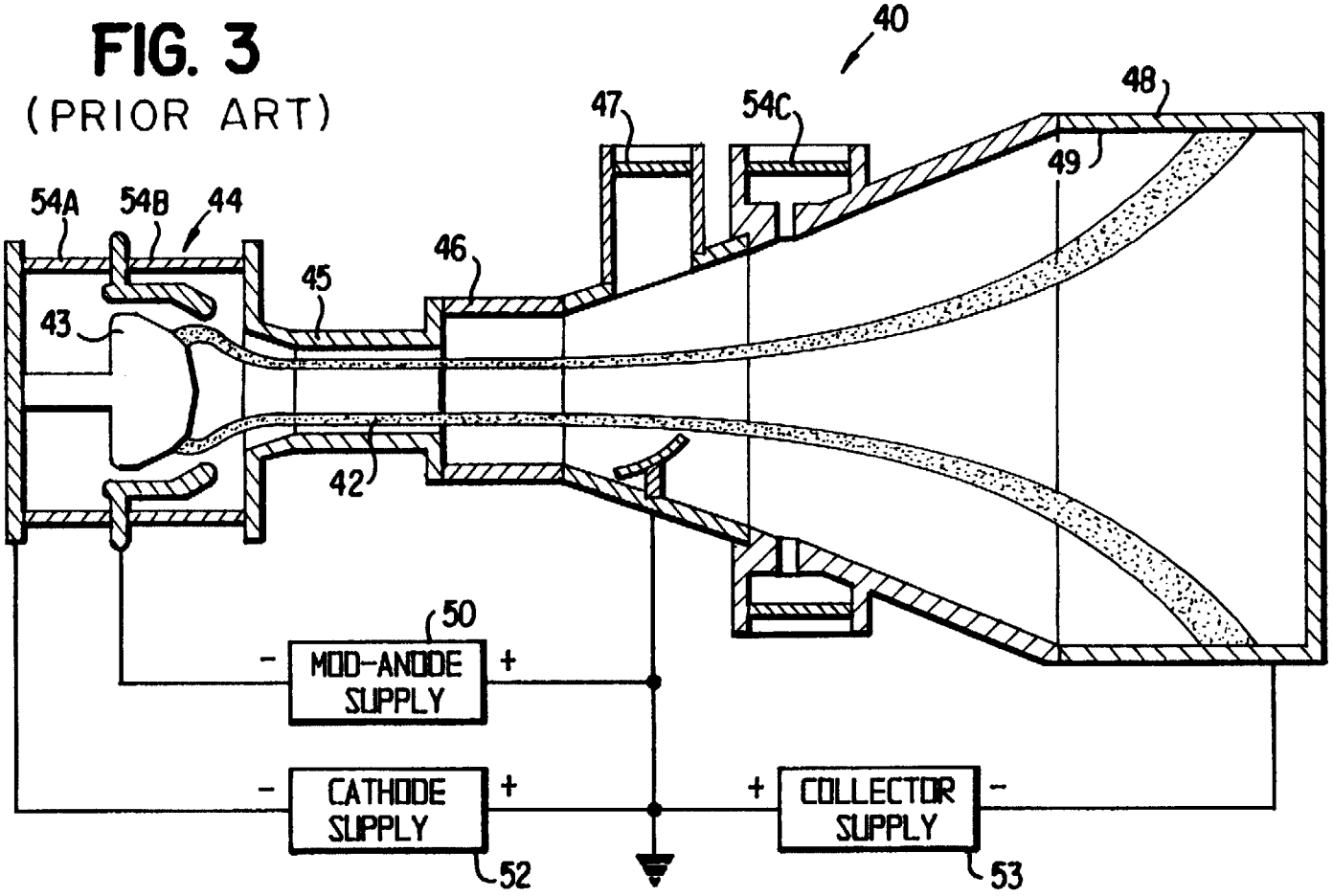
FIG. 3 (PRIOR ART)
FIG. 3 is a side sectional view of a known depressed collector for small orbit gyrotrons.
Figure 4A:
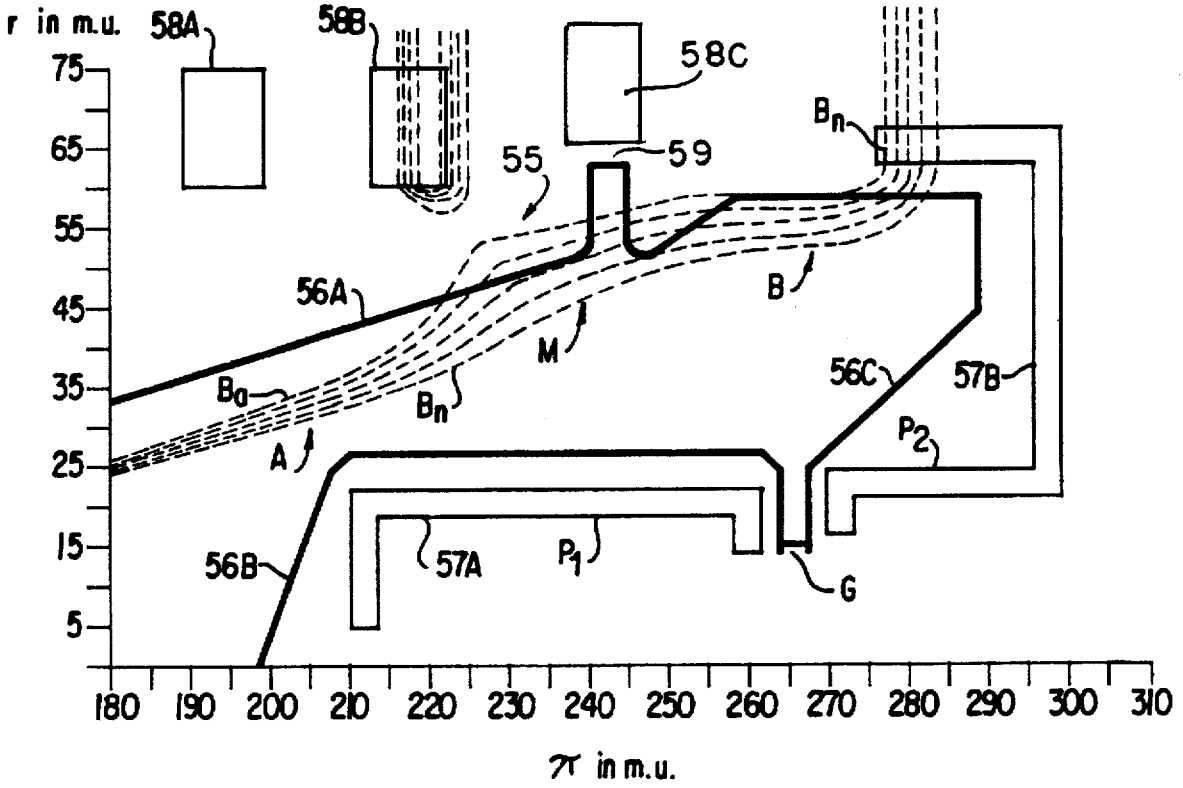
FIG. 4A is a schematic side diagrammatic view of a two stage depressed collector for small orbit gyrotrons illustrating the magnetic field configuration according to the invention.

A two stage depressed collector 55 according to an embodiment of the invention is schematically illustrated in FIG. 4A. The collector 55 comprises a housing attached to the microwave device (not shown) that contains several electrodes 56A, 56B and 56C, ferromagnetic pole pieces 57A, 57B typically made of magnetic iron, and a number of external magnetic coils 58A, 58B. The pole pieces 57A–57B and coils 58A–58B produce lines of magnetic flux, shown as dotted line B. The electric potential applied to the electrodes 56A–56C is such that in a negative sense 56A<56B<56C, i.e., 56C is the most negative. The location of the iron, the values of electrode voltage, and the magnet coil current are selected to sort the electrons in the beam by energy and direct them to the appropriate electrode surface for maximum energy recovery. The configuration of magnetic pole pieces 57A–57B and coils 58A–58B causes the beam to traverse through a combination of adiabatic $B_A$ and controlled non-adiabatic transitions Bn. The non-adiabatic transition $B_n$ helps to sort beamlets of different energy as those of lower energy tend to follow the change in direction of the magnetic flux to a greater extent than those of high energy. This non-adiabatic transition is controlled to prevent electrons from crossing excessive numbers of magnetic flux lines that would transfer significant amounts of axial energy into transverse energy. This would cause premature reflection of the electrons.

As shown in FIG. 4A, the lines B of magnetic flux that correspond with the flux enclosed by the inner and outer edges of the beam respectively in the interaction region, are given an outward bend as they enter the collector region at A, the bent lines being directed towards the rear of the collector region B.

The lines of magnetic flux that correspond with the flux enclosed by the inner and outer edges of the beam, are selectively spread out in the entrance to the collector region by the combined action of the magnetic pole pieces 57A–57B and the coils 58A–58B. The magnetic flux lines in the collector region in the vicinity of the inner collector 56C bend outward at B and tend to cross a gap 59 between the collectors 56A–56C to proceed towards the gap in the outer collectors.

The geometry of the electrodes and the magnetic pole pieces are chosen so as to make the contours of effective potential guide the electron beamlets of different energy to the appropriate collector electrodes. The effective potential is defined as follows:

$$\psi = \frac{1}{2m}\left[P_\theta - \frac{qrA_\theta}{r}\right]^2 + qV$$

where $P_\theta$ is the canonical angle momentum, $A_\theta$ is the magnetic vector potential, V is the electrostatic potential, m is the relativistic mass (for electrons, $m \equiv ym_c$ where $y=[1-(v/c)^2]^{1-2}$ where v is the electron velocity and c is the speed of light and $M_c$ is the rest mass of electrons), and q is the charge (for electrons, $q \equiv -e$). The foregoing relationships are known to those skilled in the art.

Figure 4B:
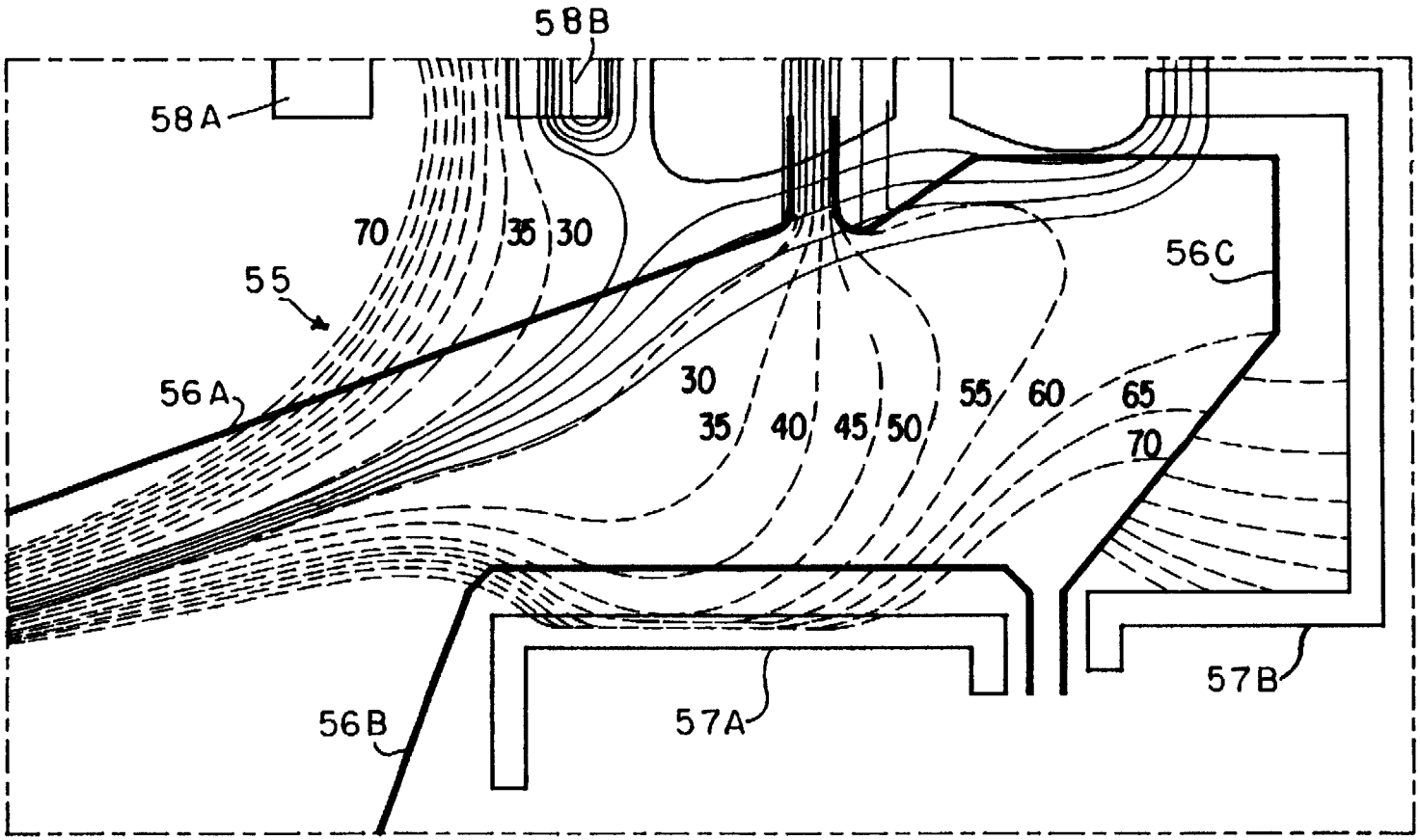
FIG. 4B is also a schematic diagram like FIG. 4A, but with contours of effective potential added as dotted lines and an illustrative set of energy values added.

FIG. 4B shows also the contours of effective potential as dotted lines. Some typical figures for electron energy are added on the contours of effective potential by way of illustration. For instance, the contours marked as 35 indicate the boundary within which electrons having an energy of 35 kev will move for this configuration.

Figure 4C:
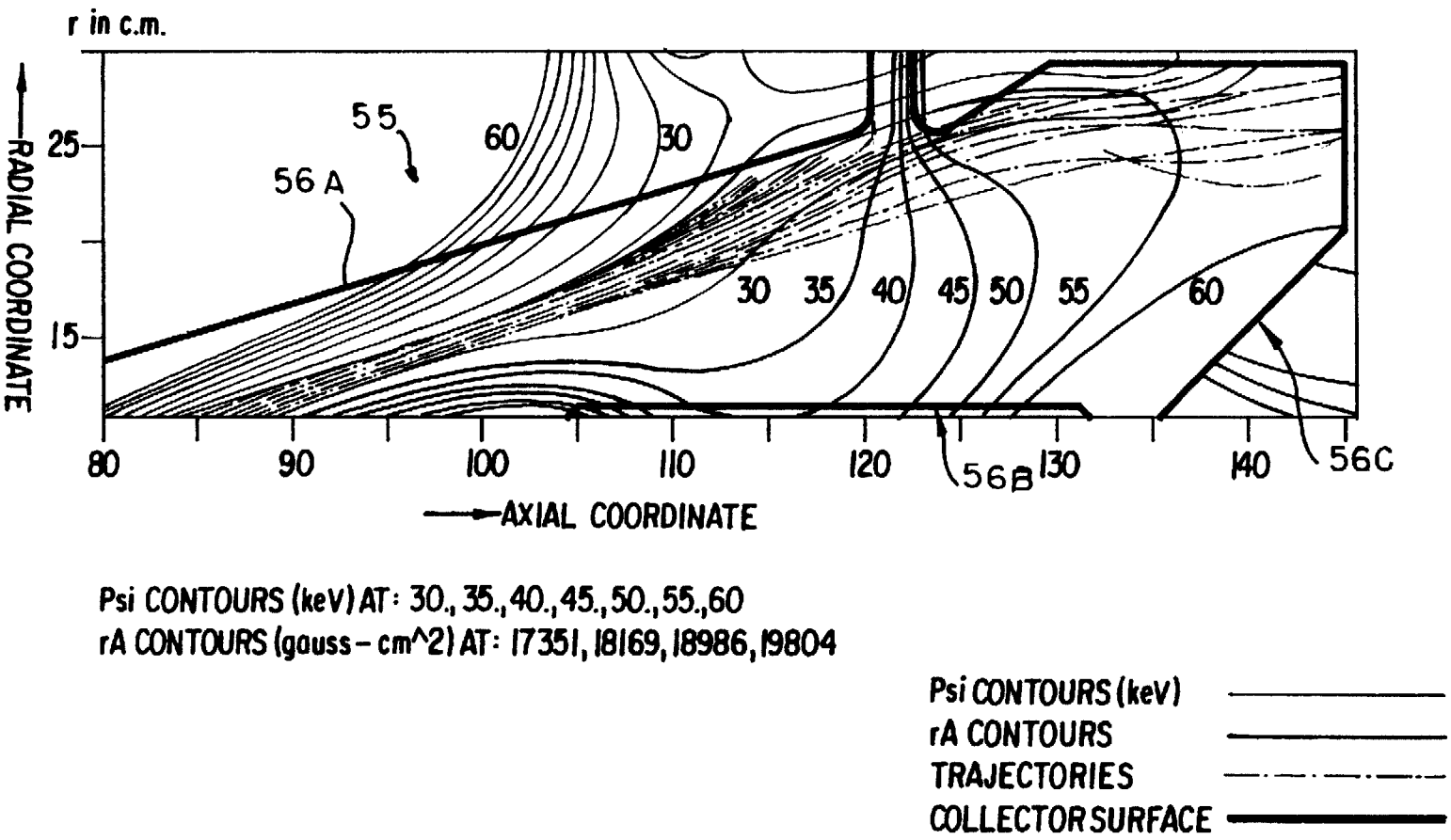
FIG. 4C is also a schematic diagram like FIGS. 4A and 4B, but it also has a sample set of electron trajectories added as dot-dot-dash lines.

In FIG. 4C, the contours of effective potential are shown as thin continuous lines, and a sample set of electron trajectories are added as dot-dot-dash lines. FIG. 4C shows that the electrons which have energy of the order of 35 kev are guided to the collector 56A. Those of higher energy cross the boundaries indicated by respective contours of higher effective potential and end up on collector 56C. The latter is at a higher depressed potential. Thus, the energy recovery is enhanced by sorting the electrons according to their energy.

Figure 5:
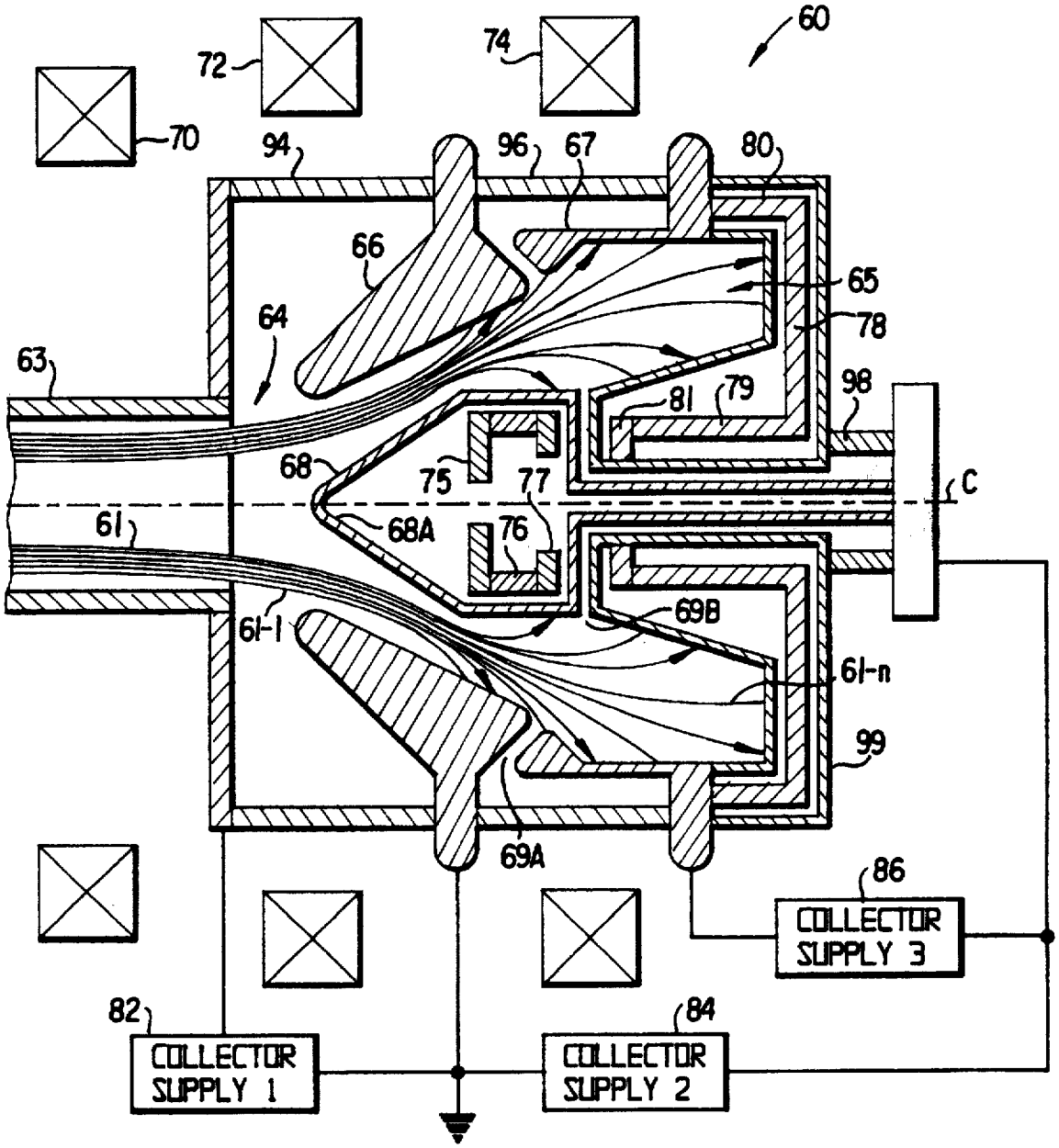
FIG. 5 is a sectional view of a multi-stage depressed collector for small orbit gyrating beams according to the invention.

An embodiment of a three stage collector device 60 is shown in FIG. 5. The arrangement has circular symmetry about centerline C. After going through the interaction region (not shown), the hollow electron beam 61 enters the collector 60 through aperture 63. The beam 61 propagates from inlet region 64 to interior region 65 separating into beamlets 61-1 . . . 61-n about centerline C. A first electrode 66 has a funnel shape to facilitate collection of lower energy electrons and for guiding higher energy electrons from inlet region 64 near to interior region 65. A second electrode 68 having a rounded tip end 68A is downstream of the inlet region 64 and is also shaped to facilitate guiding and collection of electrons. A third electrode 67 encloses the interior region 65 and is both internal and external to the region. First and third electrons 66 and 67 are separated by a gap 69A. Second and third electrodes 68 and 67 are separated by a gap 69B. Magnet coils 70, 72 and 74, and magnetic iron or pole pieces 75, 76, 77, 78, 79, 80 and 81 cause electrons with lesser energy to deflect to electrodes 66 or 68, and electrons with higher energy to impact on electrode 67.

Electrical potential on each electrode 66, 67 and 68 for each respective section is provided by power supplies 82, 84 and 86. Note that the potential of the second electrode 68 is intermediate or between the potential of the first electrode 66 and the third electrode 68. Note also that the location for ground potential is arbitrary, however, the body section 88 near inlet 63 or the outer electrode 66 may be grounded.

Shaping of the magnetic field in the collector 60 is accomplished by the axially symmetric pole pieces 75–81. Pole pieces 75, 76, 77, 79 and 81 are located on the inner side of the collector 60 and are separated by the gap 69B between the second collector 68 and the third collector 67. The pole pieces 75, 76 and 77 bridge the gap 69A between the first and third collectors 66 and 67. Thus, the incoming electrons in the beam 61 encounter a non-adiabatic transition to a lower magnetic field before encountering the substantial retarding potential of third electrode 67. Pole pieces 77 and 81 are in the form of confronting annular rings facing each other across the gap 69B to reduce the reluctance and allow magnetic flux to cross easily over the gap 69B thereby lowering the magnetic field thereat.

Pole piece 78 is a disc shaped annular member and is located rearwardly of the interior region 65. A forwardly extending annular extension 80 of pole piece 78 covers part of the outer surface of interior region 65. Electrons with higher energy are guided to this region where the potential depression is higher.

Additional field shaping is accomplished with external magnetic coils 70, 72 and 74. Annular ceramic spacers 94, 96 and 98 provide electrical isolation between sections and an external wall 99 for vacuum integrity. Spacers 94 and 96 are relatively large and surround the electrodes 66–68.

The electrodes 66, 67 and 68 are shaped to create contours of effective potential at different levels leading to the electrodes. These contours spread out and guide electrons of different energies to the optimum electrode for improved efficiency. For example, first electrode 66 has an annular conical shape and with second electrode 68 forms a channel from inlet region 64 to interior region 65.

Figure 6:
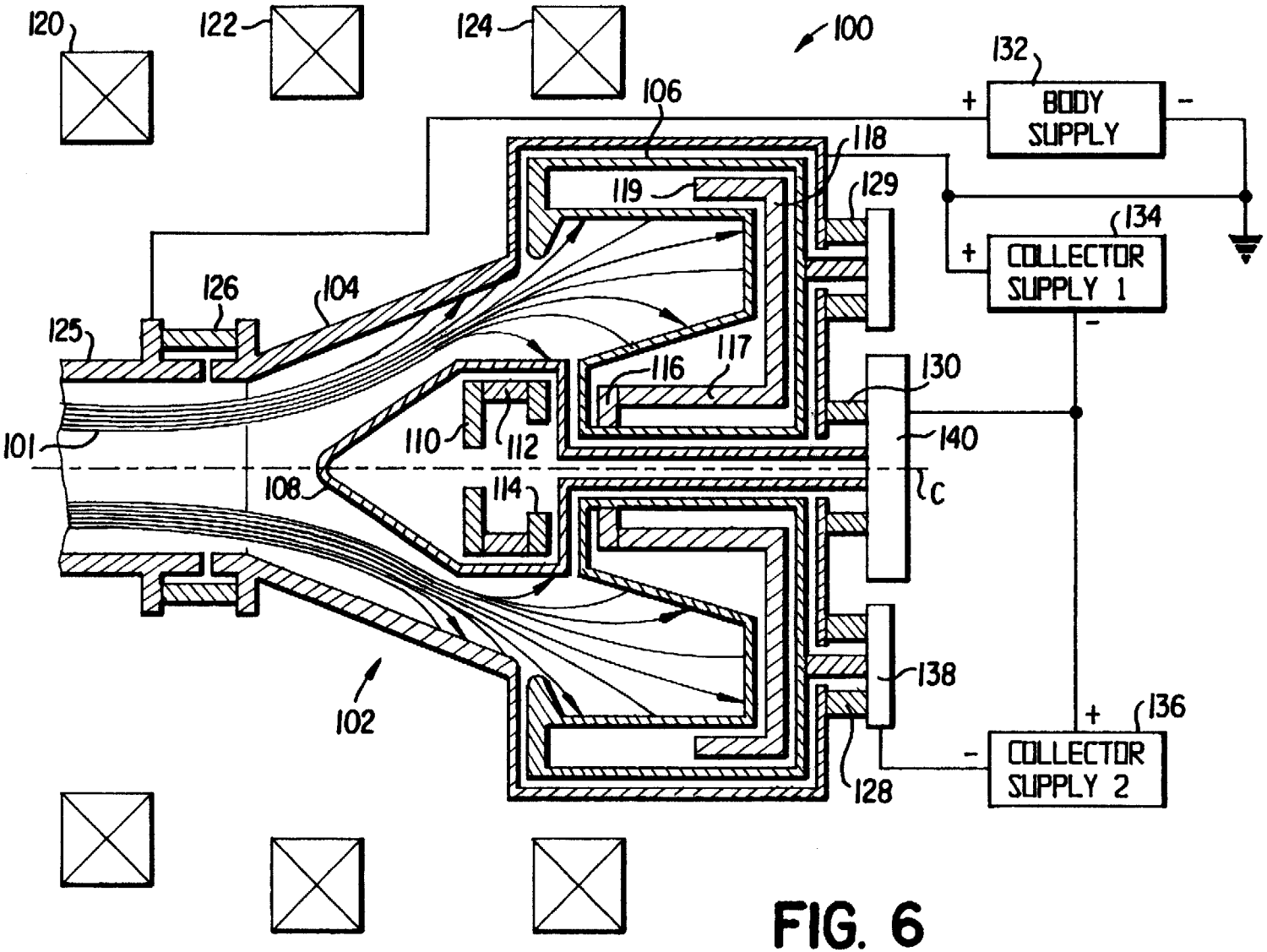
FIG. 6 is a side sectional view of an alternate embodiment a multi-stage depressed collector according to the invention.

FIG. 6 shows an alternative embodiment of the collector 100 of the invention, likewise having circular symmetry about centerline C. Hollow electron beam 101 enters into the collector region 102 where it is guided by first collector 104, second collector 108, and third collector 106, magnetic pole pieces 110, 112, 114, 116, 117, 118 and 119 and magnet coils 120, 122, 124 to the optimum collecting surface for high efficiency as previously described for the embodiment of FIG. 5.

In the embodiment of FIG. 6, first collector electrode 104 completely encloses the respective inner and central electrodes 106 and 108. First electrode 104 is also isolated from the body 125 of the microwave device by ceramic cylinder 126. First electrode 104 is isolated from inner electrode 106 by ceramic cylinders 128 and 129. Second electrode 108 is isolated from electrodes 104 and 106 by ceramic cylinder 130. The cylinders 126–130 have relatively small diameters less than any of the electrodes 104–108. This configuration provides a number of advantages. First, because the ceramic cylinders 126, 128, 129 and 130 have such smaller diameters, the cost of the ceramics is significantly reduced and the assembly process is greatly simplified. Second, the configuration of FIG. 6 provides for safer operation of the device. In this embodiment, first electrode 104, which encloses respective third and second electrodes 106 and 108, is configured to operate at ground potential. The power supply 132 for the body, or body supply 132 increases the voltage of the body of the device to a value above ground. The first electrode 104 is supplied by the grounded side of collector supply 134. The second electrode 108 is supplied by collector supply 134. The third electrode 106 is supplied by collector supply 136. The voltage of electrodes 106 and 108 are depressed to a value between ground and the cathode of the device. The electrode potential is such that outer electrode is the most positive (least negative). The third electrode 106 is most negative and second electrode has a potential between 104 and 106.

In the configuration illustrated, the only exposed surfaces on the collector at high voltage are contact and support points 138 and 140. The body section 142 is adapted to be located inside a superconducting solenoid and is not exposed to operator contact, except possibly at the output waveguide. A DC voltage block isolates the body voltage from the waveguide system attached to the output window (not shown).

Having described various embodiments of the multi-stage depressed collector for small orbit gyrotrons according to the invention, it should now be apparent to those skilled in the area that the aforestated objects and the advantages for the system have been achieved. Although the present invention was described in connection with the particular embodiments, it is evident that numerous alternatives, modifications, variations and uses will be apparent to those skilled in the art in light of the foregoing description. For example, alternative materials voltages and spacing can be selected to vary the operating characteristics of a multi-stage depressed collector as contemplated by the invention. It will also be apparent to those skilled in the art that various other changes anid modifications may be made therein without departing from the invention, and it is intended in the appended claims to cover such changes and modifications as fall within the spirit and scope of the invention.

What is claimed:

1. A multi-stage depressed collector for connection to a microwave device generating a small orbit gyrating electron beam comprised of individual electrons having varying levels of total energy, said electrons gyrating in small orbits with respect to the total beam radius and traversing into the collector where energy is recovered from the electron beam, said collector comprising:

means for sorting the individual electrons on the basis of their total energy level, including a plurality of stages, each stage including an electrode operative when energized at different voltage potentials for producing electric fields, magnetic iron for magnetic field shaping, and magnetic field generating coils, for producing, when energized, magnetic fields, the electric and magnetic fields being configured so as to direct electrons of the highest energy to the electrode with the greatest negative potential, the electrons with the lowest energy to the electrode with the least negative potential, and electrons with intermediate energies to electrodes with intermediate voltages to maximize energy recovery, the magnetic iron affecting the magnetic fields so as to produce adiabatic and controlled non-adiabatic transitions of the incident electron beam to further facilitate the sorting.

2. The collector of claim 1 including insulating ceramics for separating the collector stages.

3. The collector of claim 1 wherein the collector stages comprise coaxial electrodes and the magnetic iron comprises coaxial magnetic pole pieces.

4. The collector of claim 3 wherein the electrodes enclose portions of the pole pieces confronting the beam.

5. The collector of claim 3 wherein the pole pieces are formed with a gap allowing the electrodes to be insulated from each other.

6. The collector of claim 5 wherein the pole pieces comprise annular rings of magnetic material facing each other across the gap.

7. The collector of claim 1 wherein the collector stages and magnetic pole pieces and coil currents are shaped for generating an electric magnetic field profile for reducing transmission of electrons back toward the incoming beam.

8. The collector of claim 1 wherein one electrode forms a body portion at a potential above ground and remaining electrodes are located therein and are at depressed potentials relative thereto.

9. The collector of claim 1 wherein the microwave device has a tube body section at a potential above ground and the collector is at ground potential.

10. The collector of claim 1 comprising first and second stages, said first stage being at ground potential and surrounding the second stage being at a lower potential.

11. The collector of claim 1 wherein said electrodes comprise a first electrode; a second electrode and a third electrode surrounded by the first electrode; the first electrode and the third electrode having electric potential less than the electric potential of the second electrode.

12. The collector of claim 11 in which the electric potential of the first electrode has an electric potential less than or equal to the third electrode.

13. The collector of claim 12 wherein each stage has a radius and in which the insulating ceramics comprise annular members of selected radii less than the radius of the stages.

14. The collector of claim 1 wherein the stages comprise electrodes and insulating ceramics electrically separating the electrodes.

15. The collector of claim 1 wherein the electrodes comprise coaxially disposed first, second and third electrodes and in which the third electrode comprises an outer portion extending towards the first electrode, an inner portion extending towards the second electrode, and an intermediate portion between the inner and outer portions forming an end wall of the collector.

16. A depressed collector for a small orbit gyrotron generating a beam of electrons having varying energies, said beam centrally located about an axis of the collector for recovering energy therefrom, comprising means for receiving the individual electrons in accordance with their respective energies comprising a plurality of stages, said stages being arranged so that electrons with the lowest energy impinge on a first stage closest to the beam radially outwardly thereof; electrons of a next higher energy impinging on a second stage located centrally of the beam; and electrons of yet higher energy impinging on a third stage downstream of the first and second stages;

magnetic field generating means for producing a magnetic field when energized;

each of said plurality of stages including an electrode for producing, when energized, an electric field; and magnetic pole pieces for altering magnetic fields produced in the collector to result in the impingement of electrons according to their respective energies.

17. A multi-stage collector for connection to a device generating a small orbit gyrating beam of electrons having varying energy levels, said beam disposed about a common axis, and for recovering energy from the electron beam comprising:

a housing having an inlet for the beam disposed on the central axis, said housing being symmetrical with respect thereto; and means for attracting electrons in accordance with their respective energies comprising a first, second and third electrodes, electrons having the lowest energy being collected at the first electrode proximate the inlet, and radially outward of the beam, electrons of a next lower level of energy being collected by the second electrode located on the axis radially inwardly of the beam and electrons of a highest energy collected by the third electrode downstream of the first and second electrodes, said electrodes being energized to respective potentials increasing in a negative direction from the first through second and third electrodes; and magnetic means for producing adiabatic and controlled non-adiabatic magnetic fields to cause the electrons to be further attracted to the electrodes in accordance with their respective energies.

18. The collector of claim 17 wherein the first electrode comprises an annular conical element extending outwardly from proximate the inlet and rearwardly of the housing, and having a first corresponding potential.

19. The collector of claim 18 wherein the second electrode comprises a rounded conical tip facing the inlet and lying on an axis of the housing and being recessed downstream from the inlet and the first electrode and having a potential lower than the potential of the first electrode.

20. The collector of claim 19 wherein a third electrode extends between the first and second electrodes transverse of the axis remote and downstream thereof and having a potential lower than the potentials of said first and second electrodes.

21. A collector for connection to a micro-device generating small orbit gyrating electron beam of individual electrons having varying levels of energy, said electron beam locating about a common axis of said collector for recovering energy of said electron beam, comprising:

a housing having an inlet for receiving the beam;

means for sorting individual electrons of said beam on the basis of their respective energies comprising a plurality of stages with said individual electrons having lowest energy being collected at one of said stages closest the inlet and said individual electrons having lesser amounts of energy being collected at respective ones of said stages relatively more remote from the inlet and wherein each of said stages comprises an electrode having a respective negative potential applied thereto, the first one of the electrode stages having applied the lowest negative potential with respect to the microwave device and subsequent electrodes respectively having applied thereto increasing relative potential; and means for producing areas of adiabatic and non-adiabatic magnetic fields.

* * * * *